US007547091B2

(12) United States Patent
Hashii et al.

(10) Patent No.: US 7,547,091 B2
(45) Date of Patent: Jun. 16, 2009

(54) RECORDING APPARATUS AND LIQUID EJECTING APPARATUS

(75) Inventors: Kazuhiro Hashii, Nagano (JP); Tomoyuki Mokuo, Nagano (JP); Satoshi Ushimaru, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 428 days.

(21) Appl. No.: 11/216,425

(22) Filed: Aug. 30, 2005

(65) Prior Publication Data

US 2006/0197801 A1 Sep. 7, 2006

(30) Foreign Application Priority Data

Aug. 30, 2004 (JP) ..... P2004-250498
Aug. 8, 2005 (JP) ..... P2005-229339

(51) Int. Cl.
*B41J 23/00* (2006.01)

(52) U.S. Cl. ..... 347/37

(58) Field of Classification Search ..... 347/37, 347/58, 84, 85

See application file for complete search history.

(56) References Cited

U.S. PATENT DOCUMENTS 6,340,221 B1 * 1/2002 Driggers et al. ..... 347/37
2004/0061739 A1 * 4/2004 Lewis et al. ..... 347/37

FOREIGN PATENT DOCUMENTS

JP 2002-321351 11/2002
JP 2004-001468 1/2004

* cited by examiner

*Primary Examiner*—Stephen D Meier
*Assistant Examiner*—Alexander C Witkowski
(74) *Attorney, Agent, or Firm*—Edwards Angell Palmer & Dodge LLP; John J. Penny, Jr.

(57) ABSTRACT

A liquid ejecting head is adapted to eject liquid toward a target medium. A guide shaft extends in a first direction. A carriage reciprocately carries the liquid ejecting head in the first direction while being guided by the guide shaft. A moment generator is disposed between the carriage and the guide shaft at a position shifted from a centrium of the carriage in the first direction. The moment generator exerts a force directed in a second direction perpendicular to the first direction, thereby generating a first rotation moment in the carriage.

11 Claims, 10 Drawing Sheets

RECORDING APPARATUS AND LIQUID EJECTING APPARATUS

BACKGROUND OF THE INVENTION

The present invention relates to a recording apparatus equipped with a carriage carrying a recording head in a primary scanning direction to perform recording on a recording medium. The invention also relates to a liquid ejecting apparatus equipped with a carriage carrying a liquid ejecting head in a primary scanning direction to eject liquid toward a target medium.

The liquid ejecting apparatus refers to a recording apparatus such as a printer, copier and a facsimile machine that uses an ink jet recording head and ejects ink from the recording head to perform recording on a recording medium, as well as an apparatus that ejects suitable liquid onto a target medium from a liquid ejecting head in order to land the liquid onto the target medium.

The liquid ejecting head may be a color material ejecting head used for manufacturing a color filter for a liquid crystal display, an electrode material (conductive paste) ejecting head used for producing of an electrode for an organic EL display or a field emission display, a bioorganic matter ejecting head used for manufacturing a biochip, and a sample ejecting head serving as a micropipette.

An ink jet printer as an example of a recording apparatus or a liquid ejecting apparatus will be described. An ink jet printer comprises a carriage for carrying a recording head adapted to eject ink onto printing paper. The carriage is designed to be guided by a guide shaft extending in a primary scanning direction while being engaged with a portion of an endless belt, so that the carriage is reciprocated in the primary scanning direction while being pulled by the endless belt.

The carriage is classified into two types: a carriage that mounts an ink cartridge, so-called an on-carriage type and a carriage that does not mount an ink cartridge, so-called an off-carriage type. For an off-carriage type ink jet printer where an ink cartridge is not mounted on a carriage, an ink cartridge provided separately from the carriage and an ink jet recording head are interconnected with a flexible member such as an ink tube in which an ink channel is formed.

In this example, the flexible member has a self-restoration property to return to a straight shape. The restoring force caused by the self-restoration property acts on the carriage thus causing an adverse effect on the carriage operation thereby degrading the ink landing accuracy and recording quality.

In order to solve such a problem, Japanese Patent Publication No. 2002-321351A discloses an ink jet recording apparatus wherein an ink tube and a flexible flat cable are respectively arranged on one side and on the other side of a carriage in a primary scanning direction so that the restoring force caused by the self-restoration property of each of the tube and the cable to cancel each other thereby obtaining a balance of force applied to the carriage.

With this configuration, however, the size of the apparatus in the primary scanning direction is enlarged because it is necessary to provide spaces for the tube and the cable in both sides of the carriage. Further, it is necessary to adjust the restoring forces of both elements to an optimum level, which reduces the freedom of design. In particular, an ink tube or a flexible flat cable has the curvature of a curved part to be changed due to the travel of the carriage in the primary scanning direction. That is, the restoring force also changes so that consideration of a balance of the restoring forces of these elements to appropriately cancel each other is likely to be difficult.

In addition, in a case where the carriage is pulled by an endless belt, the direction of the force applied to the carriage differs between going stroke and returning stroke in the reciprocation of the carriage. This presents the problem of "swing" phenomenon of the carriage (described later in detail) that could result in degraded ink landing accuracy and recording quality.

SUMMARY OF THE INVENTION

It is therefore an object of the invention to provide a recording apparatus and a liquid ejecting apparatus capable of maintaining a high ink landing accuracy by operating a carriage in stable posture despite an element such as an ink supply tube or an endless belt that applies external force on the carriage, without increasing the apparatus size.

In order to achieve the above object, according to the invention, there is provided a liquid ejecting apparatus, comprising:

a liquid ejecting head, adapted to eject liquid toward a target medium;

a guide shaft, extending in a first direction;

a carriage, reciprocately carrying the liquid ejecting head in the first direction while being guided by the guide shaft; and a moment generator, disposed between the carriage and the guide shaft at a position shifted from a centrium of the carriage in the first direction, and exerting a force directed in a second direction perpendicular to the first direction, thereby generating a first rotation moment in the carriage.

The moment generator may comprise: a slider, retractably brought into contact with the guide shaft so as to be slidable thereon; and a spring, urging the slider against the guide shaft.

The liquid ejecting apparatus may further comprises: a liquid container, disposed at a position separated from the carriage and containing liquid therein; and a flexible member, connecting the liquid container and the liquid ejecting head and adapted to supply the liquid from the liquid container to the liquid ejecting head.

Here, a direction of the first rotation moment may be unchanged irrespective of a moving direction of the carriage at least when the carriage is placed within a region in which the liquid ejecting head performs liquid ejection with respect to the target medium.

Further, the flexible member may generate a second rotation moment in the carriage, which is directed in the same direction as a direction of the first rotation moment.

Here, the second rotation moment may be generated at least when the carriage is placed within a region in which the liquid-ejecting head performs liquid ejection with respect to the target medium.

Further, the liquid ejecting apparatus may further comprise a flexible flat cable, connected to the liquid ejecting head to supply signals thereto, and being deformable in accordance with the reciprocation of the carriage.

Here, the flexible flat cable and the flexible member may be extending adjacently to each other.

Further, the liquid ejecting apparatus may further comprise a flexible plate member which is deformable in accordance with the reciprocation of the carriage and is integrated with the flexible member.

The guide shaft may include a first shaft and a second shaft. Here, the carriage is formed with a bearing hole through which the first shaft extends. The second shaft supports the carriage so as to prevent the carriage from rotating about the first shaft.

According to the invention, there is also provided a recording apparatus, comprising:

a recording head, adapted to perform recording on a recording medium;

a guide shaft, extending in a first direction;

a carriage, reciprocately carrying the recording head in the first direction while being guided by the guide shaft; and a moment generator, disposed between the carriage and the guide shaft at a position shifted from a centrium of the carriage in the first direction, and exerting a force directed in a second direction perpendicular to the first direction, thereby generating a rotation moment in the carriage.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE EMBODIMENT

Embodiments of the invention will be described below in detail with reference to the accompanying drawings.

Figure 1:
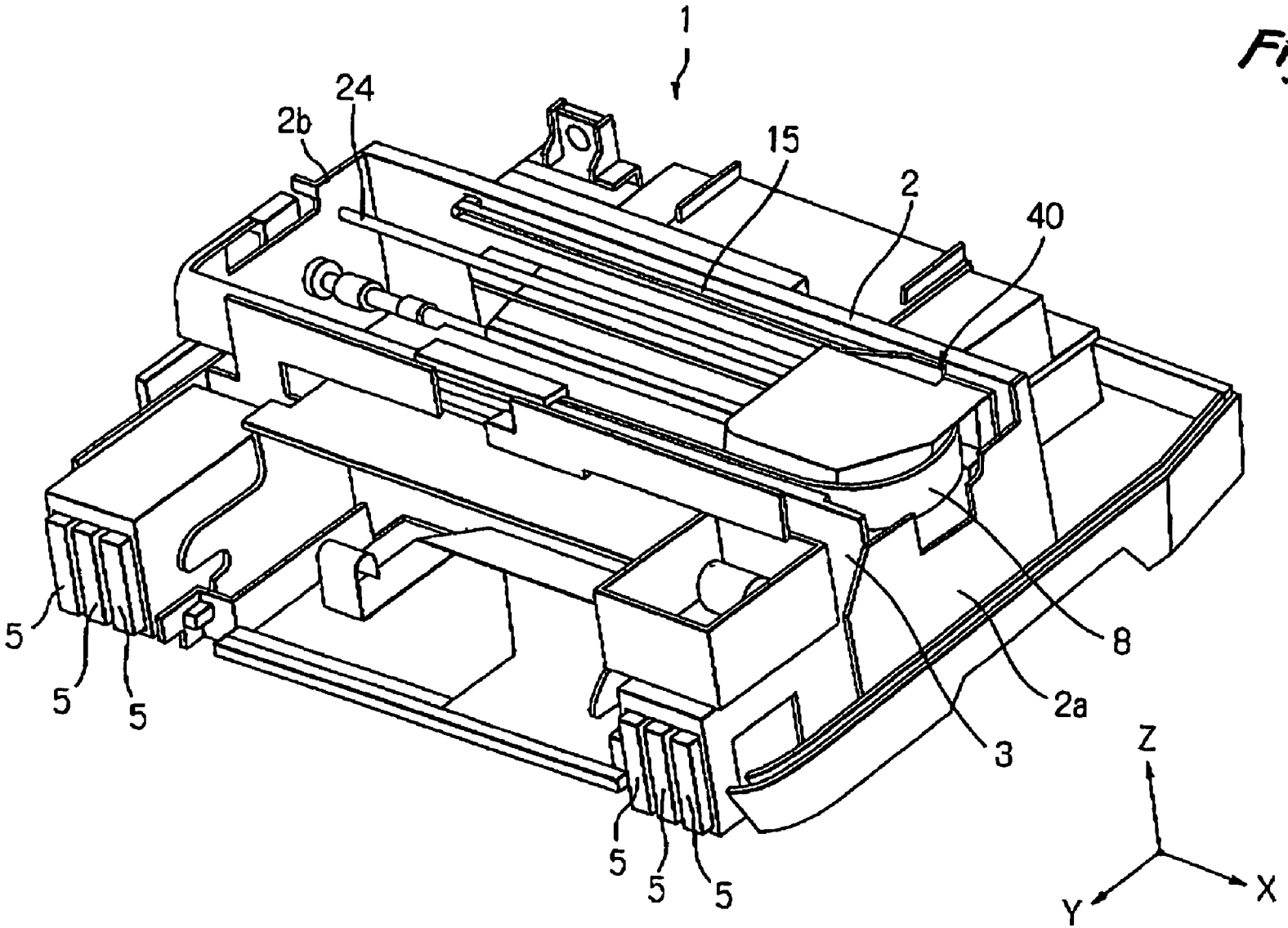
FIG. 1 is a perspective view of an ink jet printer according to a first embodiment of the invention.
Figure 2:
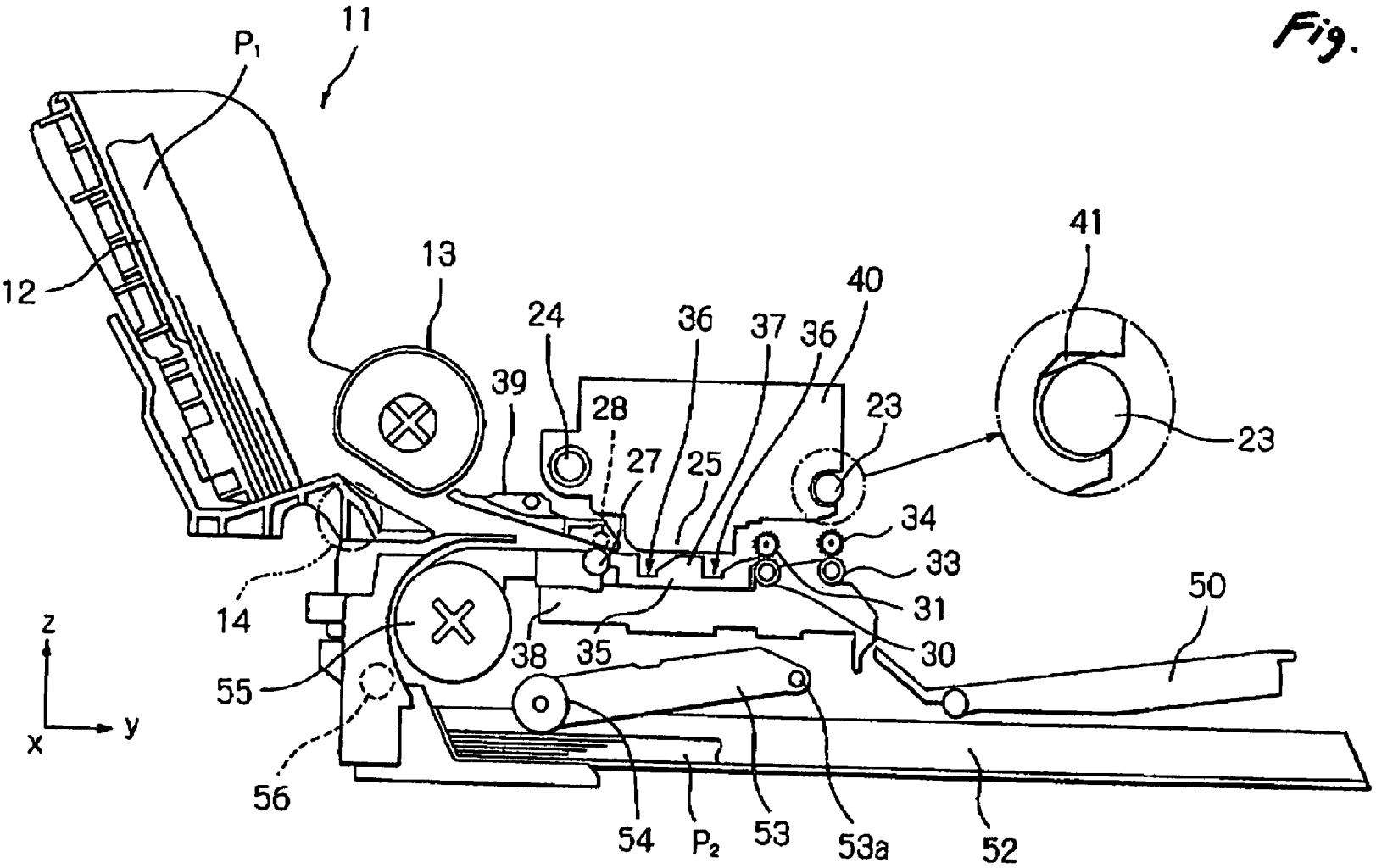
FIG. 2 is a side section view schematically showing an internal configuration of the ink jet printer of FIG. 1.

FIGS. 1 and 2 show an ink jet printer 1 (hereinafter, simply referred as a printer) according to a first embodiment of the invention. The printer 1 comprises, as a base member, a main frame 2 and a sub frame 3 extending in a primary scanning direction (x-direction) and a vertical direction (z-direction). The printer further comprises, as the base member, a right side frame 2*a* and a left side frame 2*b* extending orthogonal to the primary scanning direction (y-direction) at both ends of the main frame 2.

A main guide shaft 24 and an auxiliary guide shaft 23 are supported by the right side frame 2*a* and the left side frame 2*b* respectively at both ends thereof. The main guide shaft 24 and the auxiliary guide shaft 23 are respectively formed by a shaft body extending in the primary scanning direction and adapted to guide the carriage 40 in the primary scanning direction. Details will be given later.

In the lower part of the front of the apparatus are detachably arranged a plurality of ink cartridges 5. The ink cartridges 5 and an ink jet recording head 25 (see FIG. 2) provided at the bottom of the carriage 40 are interconnected by a flexible member 6 wherein ink channels are formed. That is, on the printer 1, the ink cartridges 5 are not mounted on the carriage 40 but are separately disposed in the body of the printer 1, which is the so-called off carriage type. The carriage 40 and the flexible member 6 are detailed later.

A paper conveying path in the printer 1 will be described mainly referring to FIG. 2.

The printer 1 comprises an automatic sheet feeder (ASF) 11 capable of setting at least one sheet of paper P1 as an example of the recording medium or the target medium in a slanted posture at the rear part of the apparatus body (left side in FIG. 1). The printer 1 also comprises a feeder tray 52 capable of setting at least one sheet of paper P2 in a horizontal posture at the bottom part of the apparatus body. The printer 1 thus comprises two sheet feeding paths. In the following description, the paper P1 and the paper P2 are collectively called "paper P" as required.

The automatic sheet feeder 11 comprises a hopper 12, a feeding roller 13, and a separating roller 14. The hopper 12 supports the paper P1 in a slanted posture. The hopper 12 is pivotable so as to switch between a state where the supported paper P1 is pressed onto the feeding roller 13 and a state where the supported paper P1 is separated from the feeding roller 13. The feeding roller 13 has a D-shaped cross section in side view. The feeding roller 13 rotates to feed the uppermost sheet of paper P1 pressed thereon toward the downstream side. The separating roller 14 is arranged to allow pressure contact with the feeding roller 13 while given a predetermined rotation resistance. In a case where a single sheet of paper P1 is fed in one pass without overlapped sending of multiple sheets of paper P1, the separating roller is rotated to follow the feeding roller 13. In a case where a plurality of sheets of paper P1 are present between the feeding roller 13 and the separating roller 14, a small friction coefficient between the sheets stops the rotation of the separating roller 14. With such action of the separating roller 14, a second and subsequent sheets of paper P1 that are being fed with the uppermost sheet of paper P1 to be fed stop near the pressure contact point between the feeding roller 13 and the separating roller 14 without advancing downstream from the feeding roller 13, thereby preventing overlapped sending of sheets.

At the downstream of the automatic sheet feeder 11 are arranged a transporting roller 27 and a transporting follower roller 28. The transporting roller 27 is formed by a long shaft body extending in the primary scanning direction while being rotated by a driving motor (not shown). The transporting follower rollers 28 are pivotally supported by holders 39 arrayed in the primary scanning direction while being pressed onto the transporting roller 27 thus are rotated in cooperation with the transporting roller 27. Paper P fed from the automatic sheet feeder 11 or the feeder tray 52 is nipped by the transporting roller 27 and the transporting follower roller 28 as well as conveyed by way of the rotation of the transporting roller 27.

At the downstream of the transporting roller 27 and the transporting follower roller 28 are arranged, while opposed to each other in vertical direction, an ink jet recording head 25 and a platen 35. The ink jet recording head 25 is arranged at the bottom of the carriage 40 and adapted to eject ink droplets on the paper P during the reciprocation of the carriage 40 in the primary scanning direction, thereby executing recording on the surface of the paper P. As mentioned above, the carriage 40 is guided. In the primary scanning direction by the main guide shaft 24 and the auxillary guide shaft 23. The carriage 40 is engaged with a part of the endless belt 15 which is wound over a driving pulley 16 attached to a carriage motor 21 arranged in a home position side (right side in FIG. 3) and a follower pulley 17 provided in an away position side (left side in FIG. 3), and is pulled in the primary scanning direction by way of the power of the carriage motor 21.

The platen 35 extends in the primary scanning direction and supports the paper P so as to maintain a prescribed distance between the paper P and the ink jet recording head 25. The platen 35 includes a recessed part 36 on a face opposing the ink jet recording head 25. In the recessed part 36 are arrayed island parts 37 in the primary scanning direction. With this arrangement, ink ejected at portions outside a leading end, a trailing end of and both side ends of the paper P is discarded in the recessed part 36 to execute marginless printing. In the recessed part 36 is arranged an ink absorbing material (not shown) for absorbing discarded ink. In the bottom of the recessed part 36 is formed a hole (not shown) in communication with the bottom of the platen 35. The hole is used to guide the discarded ink into a waste liquid container 38 provided at the lower part of the platen 35.

Returning to FIG. 2, at the downstream of the ink jet recording head 25 are provided a first ejecting roller 30, a first ejecting follower roller 31, a second ejecting roller 33, and a second ejecting follower roller 34. The first ejecting roller 30 and the second ejecting roller 33 are rotated by a driving motor (not shown). The first ejecting follower roller 31 and the second ejecting follower roller 34 are pressed on the first ejecting roller 30 and the second ejecting roller 33 respectively, so as to be rotated in cooperation with the first ejecting roller 30 and the second ejecting roller 33. The paper P having passed through the platen 35 is nipped by these rollers and ejected to a stacker 50.

In the upper area of the rear end of the feeder tray 52 is arranged a pickup roller 54. The pickup roller 54 is pivotally supported by a support member 53 which is pivotable about an axis 53*a* while being rotated by a driving motor (not shown). With the pivot operation of the support member 53, the pickup roller 54 is placed either in a position where it is pressed onto the paper P2 set in the feeder tray 52 and a position where it is separated from the paper P2. The pickup roller 54 rotates while being pressed onto the paper P2 to feed the uppermost sheet of paper P2 toward the rear side of the printer 1 (leftward in FIG. 2).

At the rear end of the feeder tray 52 is provided a reversing roller 55 rotated by a driving motor (not shown) and formed a transporting path for the paper P2 extending around the reversing roller 55. At the position opposed to the reversing roller 55 is provided a nipping roller 56 placed either in a position where it is pressed onto the reversing roller 55 and a position where it is separated from the reversing roller 55. The paper P2 fed by the pickup roller 54 then passes through the pressure contact point between the reversing roller 55 and the nipping roller 56, thereby preventing overlapped sending of sheets as well as adding a feeding force by the rotation of the reversing roller 55 thus being fed further downstream. The paper P2 passes through the transporting path and nipped by the transporting roller 27 and the transporting follower roller 28 and conveyed downstream, as same as the paper P1 conveyed by the automatic sheet feeder 11.

Figure 3:
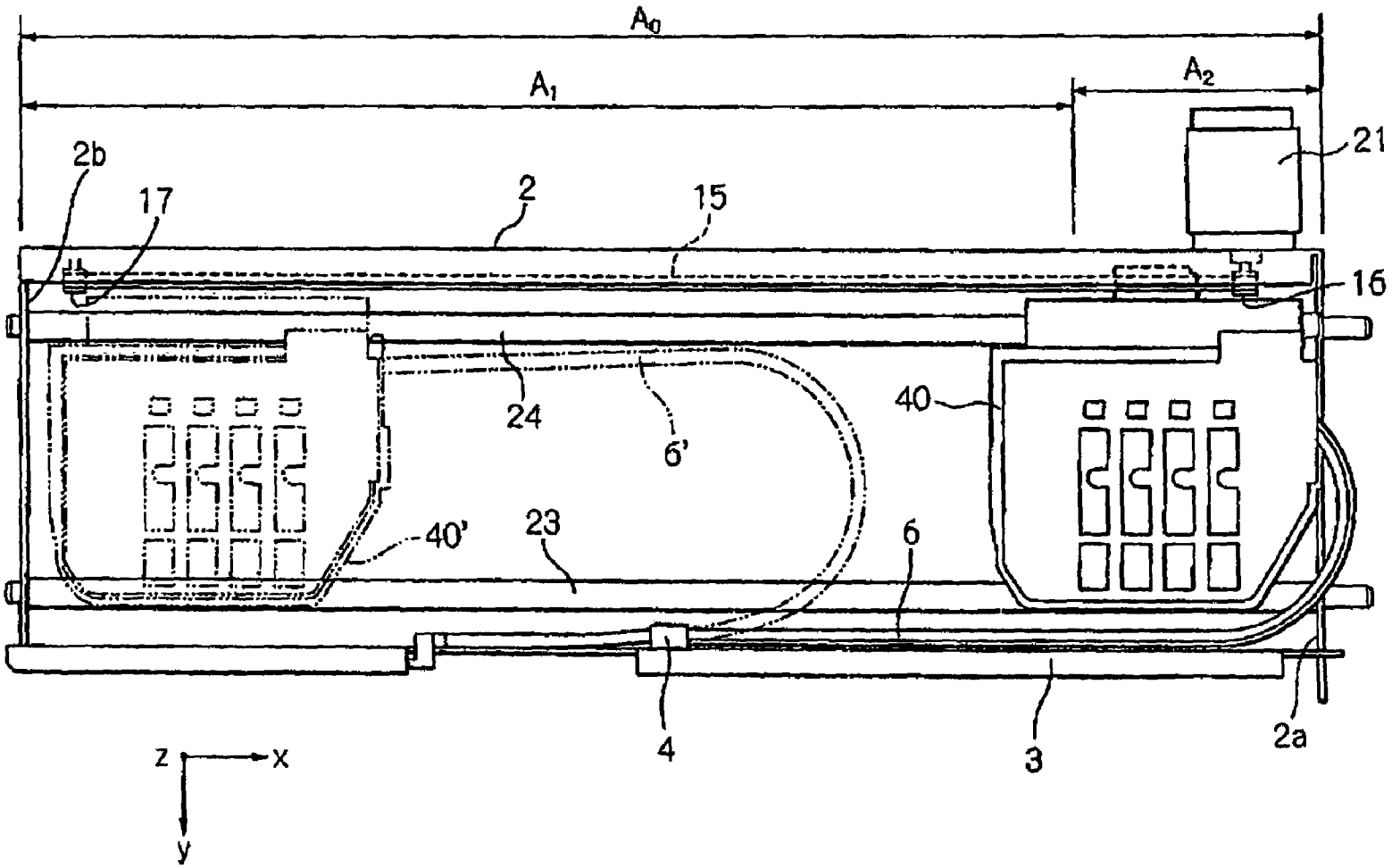
FIG. 3 is a top view of a printing section in the ink jet printer of FIG. 1.

As shown in FIG. 3, the carriage 40 is arranged to travel in the reciprocating area A0. The reciprocating area A0 includes a recording area A1 for ejecting ink onto paper P to actually execute recording on the paper P. An area A2 at the rightmost part of the reciprocating area A0 includes a home position of the carriage 40 and a maintenance area of the ink jet recording head. 25. While printing is not performed, the carriage 40 is standby at a position shown in solid lines in FIG. 3.

A flexible member 6 connecting the ink cartridge 5 and the ink jet recording head 25 extends along the frame surface of the sub frame 3 to the home position of the carriage 40 from a retainer 4 arranged at the middle part of the sub frame 3, is bent and inverted to form an U-shape appearance in plan view, and fixed inside the carriage 40. When the carriage 40 moves from the home position to the away position (leftward in the figure), the flexible member 6 changes Its bent state in accordance with the movement of the carriage 40. In FIG. 3, reference numerals 6' and 40' respectively denote the carriage 40 and the flexible member 6 when the carriage 40 is placed in the away position.

Figure 4:
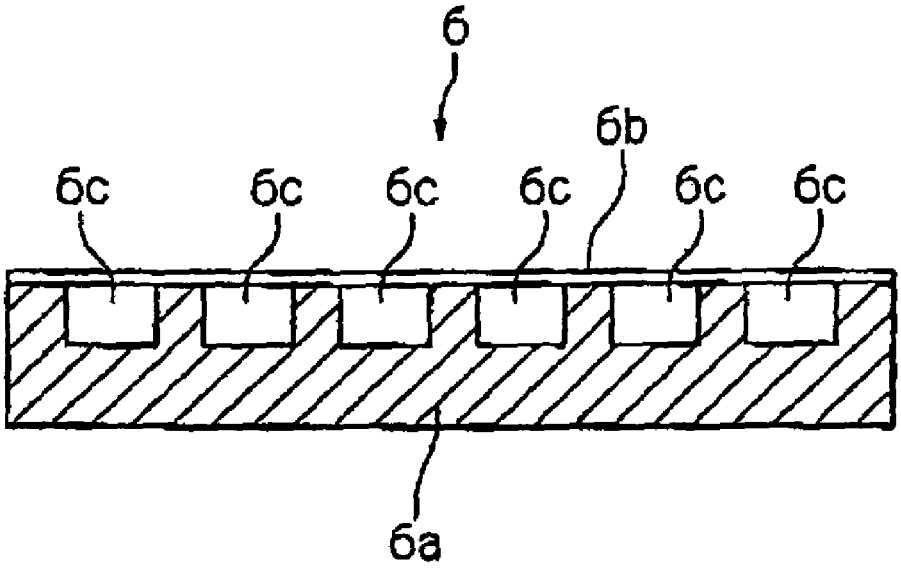
FIG. 4 is a section view of an ink supply tube in the ink jet printer of FIG. 1.

As shown in FIG. 4, the flexible member 6 comprises a main body 6*a* and a film 6*b* affixed thereto. The main body 6*a* is formed of a material that has elasticity (flexibility) and inkproof property. While a styrene elastomer (for example styrene-ethylene-butylene block copolymer) is used in this embodiment, any material having ink resistance property as well as elasticity (flexibility) may be used. For example, NBR (acrylonitrile-butadiene rubber) or SBR (styrene/butadiene rubber) may be used.

In the main body 6*a* are formed a plurality of grooves 6*c*. To the surface where the grooves 6*c* are formed is affixed the film 6*b*, which thereby forms a plurality of ink channels. While the film 6*b* is made of PP (polypropylene) which is fused to the main body 6*a* by heat in this embodiment, any material having inkproof property that can be affixed to the main body 6*a* may be used.

Figure 5:
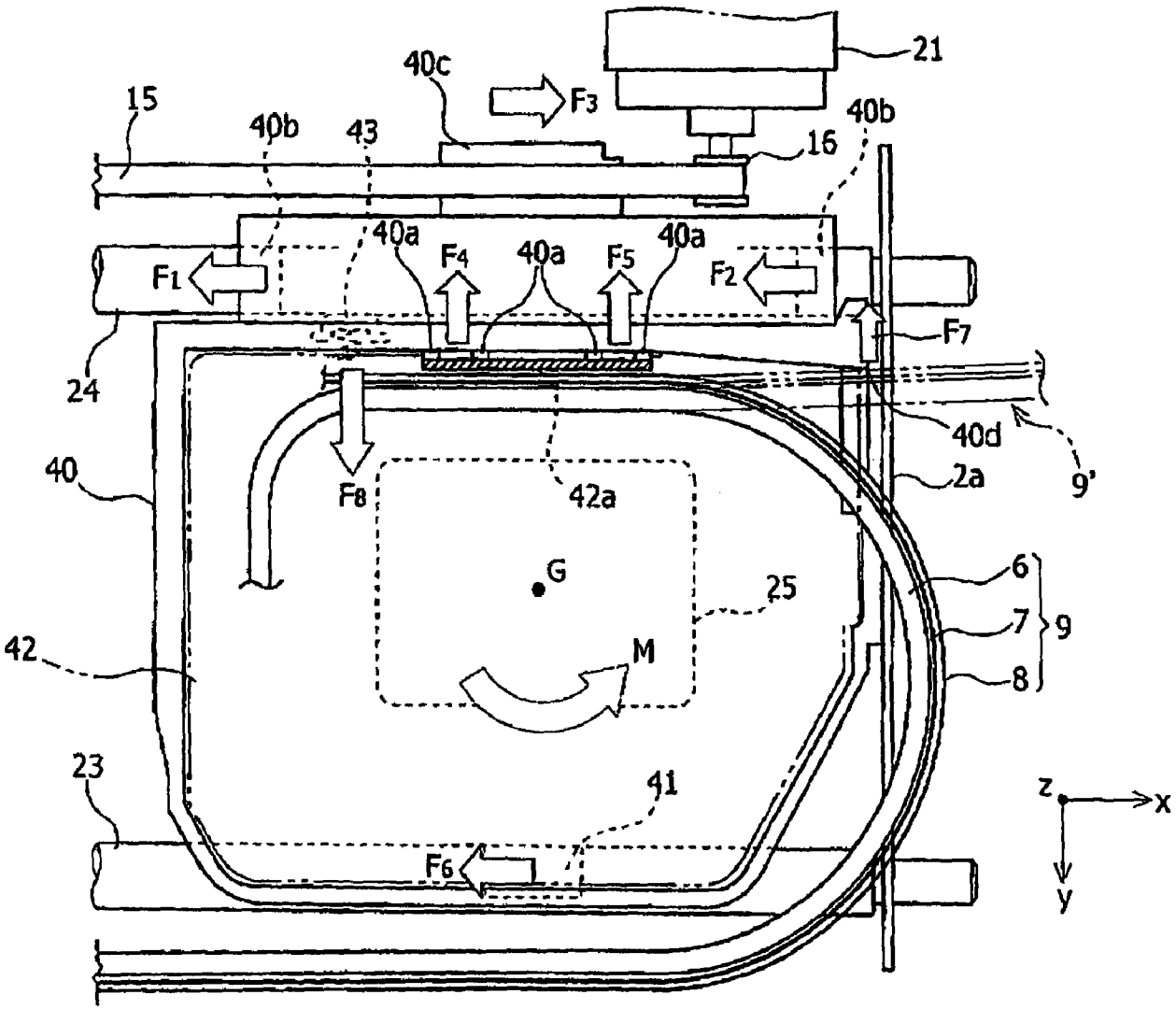
FIG. 5 is a top view of a carriage in the ink jet printer of FIG. 1, for explaining forces applied to the carriage.

In this embodiment, as shown in FIG. 5, a flexible flat cable (hereinafter referred to as FFC) 7 and a plate member 8 are routed to be adjacent to the flexible member 6. The FFC 7 is a flat cable having flexibility and connects the control circuit (not shown) of the printer 1 and the ink jet recording head 25. The plate member 8 is formed of a thin metal plate having elasticity (flexibility) and is positioned outside the curbed part of the flexible member 6 and the FFC 7 in order to protect the flexible member 6 and the FFC 7 as well as to give a certain force to the carriage 40 (this will be detailed later). The FFC 7 and the plate member 8 extend, same as the flexible member 6, rightward in the primary scanning direction along the frame surface of the sub frame 3 from the retainer 4 of the sub frame 3, and is bent and inverted to be fixed inside the carriage 40.

In the following description, the flexible member 6, FFC 7 and plate member 8 are generally called the "band-shaped elastic member 9".

Next, a force exerted on the carriage 40 will be detailed. The carriage 40 is guided in the primary scanning direction as the main guide shaft 24 is inserted into the bearings 40*b* provided with predetermined spacing apart in the primary scanning direction. The carriage 40 is supported, from below, by the auxiliary guide shaft 23 that supports the carriage 40 so as to stop rotation of the carriage 40 about the main guide shaft 24. Thus, the carriage 40 undergoes friction resistance at the bearings 40*b* and a slider 41 (see also FIG. 2) in its movement in the primary scanning direction. FIG. 5 shows a force exerted on the carriage 40 while the carriage 40 is moving from the away position side to the home position side (from left to right in the figure). Signs F1, F2 denote friction generated at the bearings 40*b*. A force denoted by a sign F6 similarly indicates friction generated at the slider 41. The direction of the forces F1, F2, F6 is reversed when the carriage 40 moves from the home position side to the away position side (from right to left in the figure), The carriage 40 is engaged with the endless belt 15 through a belt retainer 40*c* and pulled by the same. Thus, a force F3 as the pulling force is exerted on the belt retainer 40*c*.

Further, a restoring force caused by the self-restoration property of the band-shaped elastic member 9 comprising the flexible member 6, the FFC 7 and the plate member 8 is exerted on the carriage 40. To be more specific, inside the carriage 40 are formed four ribs 40*a* extending in the height direction (z-direction) in appropriate spacing in the primary scanning direction (x-direction). The band-shaped elastic member 9 is in contact with the rib 40*a* via a plate part 42*a* formed on a cover 42 of the carriage 40. Thus, the carriage 40 receives a force denoted by signs F4, F5 from the band-shaped elastic member 9, that is, a force urging toward the main guide shaft 24, at the position of the rib 40*a*. The four ribs 40*a* are arranged in four positions of which two positions are symmetrical with respect to the centrium G of the carriage 40 in the primary scanning direction as shown in FIG. 5. The two ribs 40*a* on each of the left side and the right side are close to each other so that forces F4, F5 are exerted on two positions of the carriage 40 as shown in the figure. Thus, the forces F4, F5 are exerted on positions symmetrical with respect to the centrium G of the carriage 40 in the primary scanning direction in plan view of the carriage 40.

FIG. 5 shows a case where the carriage 40 is placed in the home position side as shown in solid lines in FIG. 3, when the carriage 40 is placed on the away position side as shown by dashed lines and the numeral 40' in FIG. 3, the band-shaped elastic member 9 presses an edge 40*d* formed inside the carriage 40 toward the main guide shaft 24 as shown by dashed lines and the numeral 9 'in FIG. 5, so that the carriage 40 receives a force denoted by a sign F7.

The forces F1 through F7 generates a rotation moment about the centrium G in plan view. In particular, in the example of FIG. 5 where the carriage 40 is pulled from the away position side to the home position side (rightward in the figure), forces F1, F2, F5, F7 generate a rotation moment to rotate the carriage 40 counterclockwise about the centrium G (in the direction shown by the arrow M). Forces F3, F4, F6 generate a rotation moment to rotate the carriage 40 clockwise about the centrium G (in the direction opposite to the arrow M).

To the contrary, in a case where the carriage 40 is pulled from the home position side to the away position side (leftward in the figure), the forces F1, F2, F3, F6 are reversed (the reversed force is hereinafter represented in the subscript R), forces F3R, F5, F6R, F7 generate a rotation moment to rotate the carriage 40 counterclockwise about the centrium G (in the direction denoted by the arrow M). Forces F1R, F2R, F4 generate a rotation moment to rotate the carriage 40 clockwise about the centrium G (in the direction opposite to the arrow M).

From the foregoing description, when the direction of the sum of the above rotation moments about the centrium G generated on the carriage 40 (resultant rotation moment generated on the carriage 40) changes, the "swing" phenomenon of the carriage 40 is generated, which degrades the ink landing accuracy. In other words, as long as the direction of the sum of the rotation moments about the centrium G is made constant it is possible to maintain high ink landing accuracy. Thus, in this embodiment, a moment generator is provided to give a force denoted by a sign F8, that is, a force orthogonal to the axial direction of the main guide shaft 24 so that the sum of the rotation moments generated on the carriage 40 will be in the counterclockwise direction (direction denoted by the arrow M) in FIG. 5, which prevents the swing phenomenon of the carriage 40.

Figure 6:
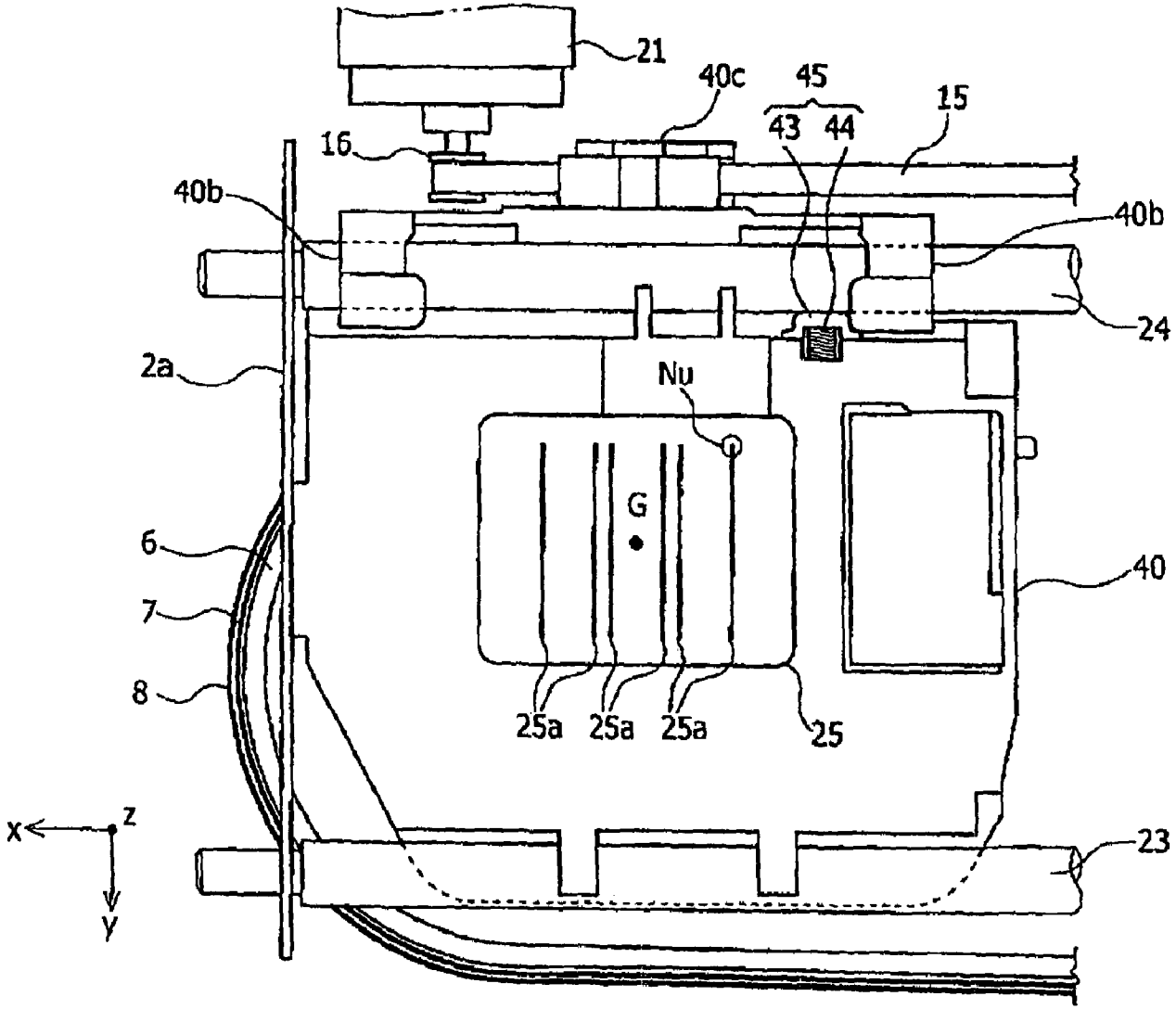
FIG. 6 is a bottom view of the carriage of FIG. 5.

Further, the moment generator 45 for providing a force F8 to the carriage 40 comprises a slider 43 and a compression spring 44 as shown in FIG. 6. The slider 43 is provided in a position deviated in the primary scanning direction from the centrium G of the carriage 40 (the away position side of the centrium G) and retractably brought into contact with the main guide shaft 24 so as to be slidable thereon. The compression spring 44 urges the slider 43 toward the main guide shaft 24.

In a case where the force F8 by the moment generator 45 is not exerted, for example when the carriage 40 is pulled from the away position side to the home position side as shown in FIG. 5 (rightward in the figure), the pulling force F3 by the endless belt 15 has a great effect, so that the sum of the rotation moments generated on the carriage 40 is in the clockwise direction (direction opposite to the arrow M). In a case where carriage 40 is pulled from the home position side to the away position side (leftward in the figure), the sum of the rotation moments generated on the carriage 40, influenced by the force F3R, is in the counterclockwise direction (direction denoted by the arrow M) in FIG. 5. When the carriage stopped at the away position is pulled toward the home position (rightward in the figure), the friction state at the bearings 40*b* and the slider 41 changes from static friction to dynamic friction, so that the swing phenomenon of the carriage 40 becomes remarkable in the vicinity of the away position.

Figure 7:
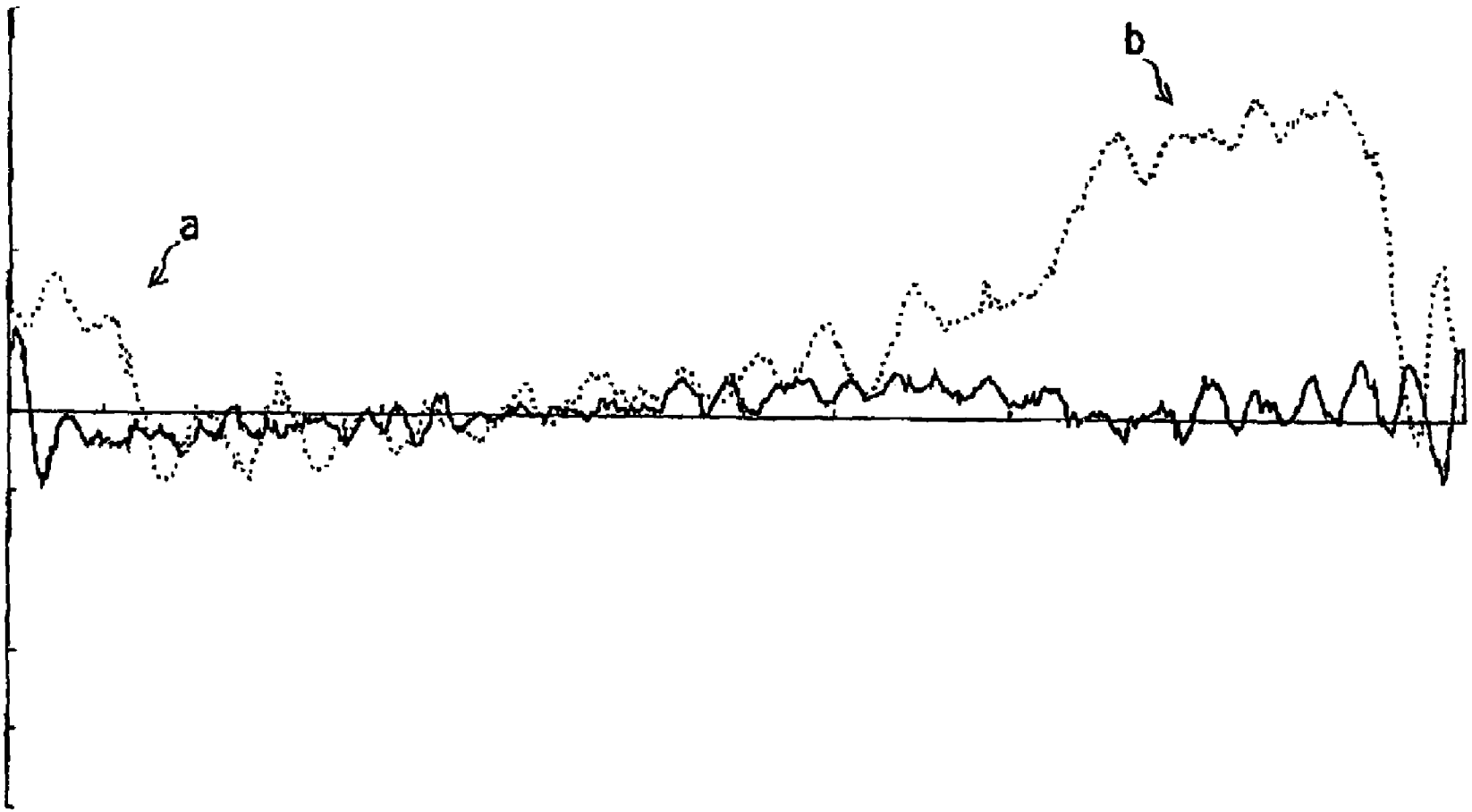
FIG. 7 is a graph for explaining an effect of provision of a moment generator in the ink jet printer of FIG. 1.

FIG. 7 shows deviations in ink landing positions in association with the positions of the carriage 40 in the primary scanning direction. The rightmost part of this figure corresponds to the home position (the rightmost part in FIG. 3) and the leftmost part of this figure corresponds to the away position (the leftmost part in FIG. 3). The upper side of the figure corresponds to the upward direction in FIG. 3 and the lower side of the figure corresponds the downward direction in FIG. 3. The deviation in ink landing positions means a difference (distance) between a landing position of ink elected when the carriage 40 is placed in a certain position in the primary scanning position on the way of moving from the home position side to the away position side and a landing position of ink ejected when the carriage 40 is placed in the certain position on the way of moving from the away position side to the home position side. Each landing position is actually measured with respect to ink ejected from a nozzle Nu (see FIG. 6) of the ink jet recording head 25. The nozzle Nu is a nozzle that is positioned in an end of a nozzle array in an upstream side in the secondary scanning direction). This nozzle array is positioned closest to the away position side of the carriage 40.

In a case where the force F8 is no exerted, as shown by dashed lines in FIG. 7, the deviation becomes remarkable in the vicinity of the away position side, that is, near the position that the carriage 40 switches from the going stroke to the returning stroke (part denoted by a sign "a"). Further, the deviation becomes remarkable also when the carriage returns to the home position (part denoted by a sign "b"). This is because, while the band-shaped elastic member 9 exerts the force F7 shown in FIG. 5 on the carriage 40 up to midway from the away position side, the bending state of the band-shaped elastic member 9 changes so that it is away from the edge 40*d* during the returning stroke and the force F7 is no longer applied to the carriage 40. That is the amount and direction of the resultant rotation moments acting on the carriage 40 changes, thereby the swing phenomenon of the carriage 40 is occurred.

When the force F8 is exerted by the moment generator 45, the direction of the resultant rotation moment on the carriage 40 is generally counterclockwise (direction of the arrow M shown in FIG. 5). This considerably reduces the swing phenomenon of the carriage 40 thereby substantially eliminating the deviation of the ink landing positions as shown by the solid lines in FIG. 7.

That is, in the plan view of the carriage 40, by the moment generator 45 arranged in a position deviated in the primary scanning direction from the centrium G of the carriage 40, the moment generator 45 exerting an urging force in a direction crossing the axial direction of the main guide shaft 24 (in a direction orthogonal thereto in this embodiment) between the main guide shaft 24 and the carriage 40 in order to give a rotation moment to the carriage 40, the carriage 40 is constantly given a rotation moment in a fixed direction. This allows the sum of the rotation moments generated on the carriage 40 to be exerted in a fixed direction (direction denoted by the arrow M in this embodiment) almost over the entire recording area A1. This considerably reduces the swing phenomenon of the carriage 40. As a result, it is possible to reduce the degradation of recording quality caused by poor ink landing accuracy. In particular, in this embodiment, even though the band-shaped elastic member 9 exerts forces F4, F5, F7 on the carriage 40 in the off-carriage type printer, the moment generator 45 prevents or reduces the degradation of ink landing accuracy.

The force F8 the moment generator 45 exerts on the carriage 40 is preferably set to generate a rotation moment in a fixed direction on the carriage 40 (so that the sum of the rotation moments given to the carriage 40 is constantly directed in a fixed direction) irrespective of the force given to the carriage 40 by the band-shaped elastic member 9, that is, irrespective of the magnitude of the forces F4, F5, F7, at least in the entire recording area A1 in the reciprocating area A0 of the carriage 40. In this embodiment, the force F8 is set so that a rotation moment (sum of the rotation moments caused by forces F1 through F7) on the carriage 40 in a direction denoted by the sign M is generated in the entire recording area A1. This prevents the swing phenomenon of the carriage 40 more reliably.

In this embodiment, the band-shaped elastic member 9 gives a rotation moment to the carriage 40 by way of the force F7 which rotation moment has the same direction as one given to the carriage 40 by the moment generator 45 (rotation moment by way of the force F8). This helps prevent the swing phenomenon of the carriage 40 and more reliably prevents the degradation of ink landing accuracy.

The band-shaped elastic member 9 is formed by the flexible member 6 as well as the FFC 7 and the plate member 8 routed adjacently to the flexible member 6. This increases the force F7 and enhances the swing prevention of the carriage 40 by the moment generator 45 (force F8).

Figure 8:
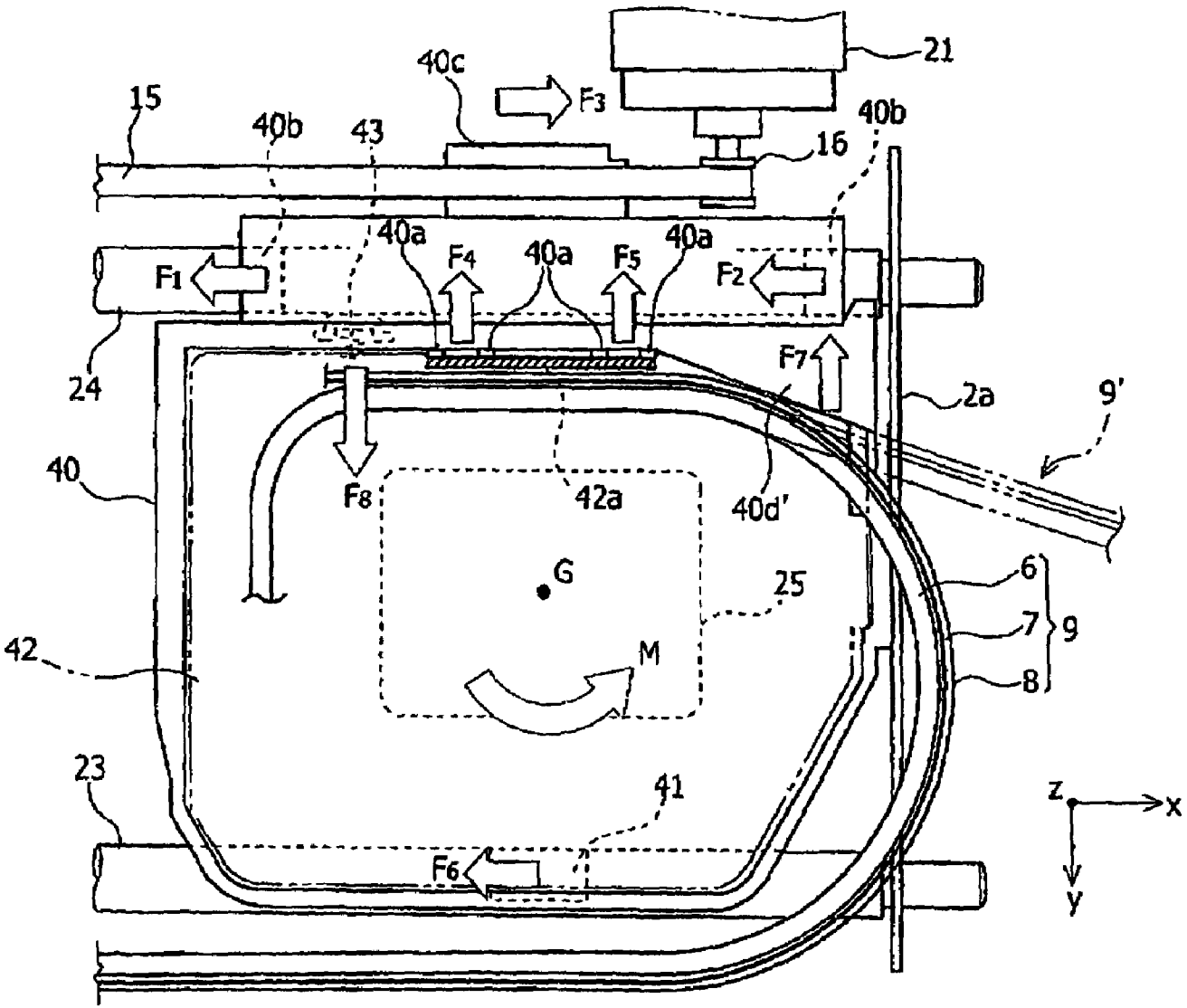
FIG. 8 is a top view of a carriage in a modified example of the ink jet printer of FIG. 1.

As shown in FIG. 8, by forming an edge 40' so that the carriage 40 always receives the restoring force caused by the self-restoration property of the band-shaped elastic member 9, at least during a recording process, it is possible to more reliably prevent deviation in the ink landing positions.

To be more specific, at least in the entirety of the recording area A1 in the in the reciprocating area A0 of the carriage 40, the band-shaped elastic member 9 gives the force F7 to the carriage 40. In other words, at least in the recording area A1, a phenomenon that the force F7 is sometimes generated and sometimes not generated must be avoided. This considerably reduces the deviation in ink landing positions caused by the swing phenomenon of the carriage 40 thereby maintaining high ink landing accuracy. This advantage is available even in the absence of the urging force exerted by the moment generator 45 (force F8), thereby reducing or preventing the deviation in ink landing positions.

Next, a second embodiment of the invention will be described. Components similar to those in the first embodiment will be designated by the same reference numerals and repetitive explanations for those will be omitted.

Figure 9:
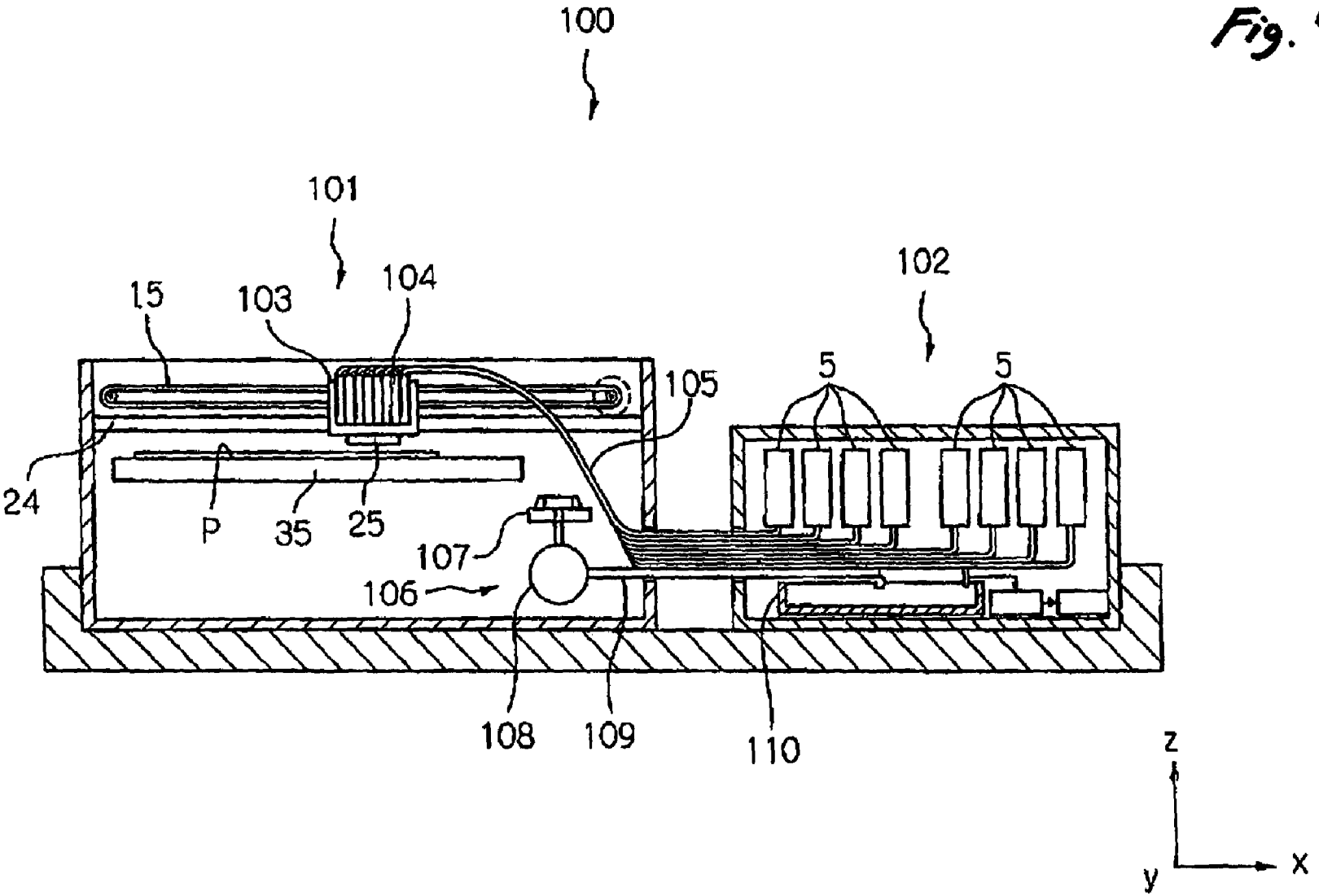
FIG. 9 is a schematic section view of an ink jet printer according to a second embodiment of the invention.

In FIG. 9, a printer 100 comprises a printing section 101 and an ink supply and collection unit 102 for supplying ink and collecting waste ink from the printing section 101. In the printing section 101, a carriage 103 mounting a recording head 25 is pulled in a primary scanning direction (x-direction) by the power of a carriage motor (not shown in FIG. 9) while being guided by a guide shaft 24.

The carriage 103 according to this embodiment comprises a plurality of (eight in this embodiment) ink reservoir 104. To each ink reservoir 104 is connected an ink supply tube 105 extending from the ink supply and collection unit 102. The ink supply tube 105 connects the ink reservoir 104 provided in the carriage 103 to an ink cartridge 5 provided in the ink supply and collection unit 102. Ink supplied from the ink cartridge 5 is temporarily stored by the ink reservoir 104 and supplied to the recording head 25. With this configuration, a large-capacity ink cartridge 5 may be available, which eliminates the need for frequently replacing ink cartridges and enhances convenience.

On the printing section 101 is provided a home position of the carriage 103. At the home position is provided a cleaning mechanism including a cap and a suction pump 108. The cap 107 is arranged to be movable in the vertical direction (z-direction) by a drive mechanism (not shown). When the carriage 102 has returned to the home position, the cap 107 elevates and seals the recording head 25. The ink supply and collection unit 102 includes a waste ink container 110. The waste ink container 110 is connected to the suction pump 108 via an ink eject tube 109. Ink sucked from the recording head 25 is collected into the waste ink container 110 via the ink eject tube 109.

Figure 10:
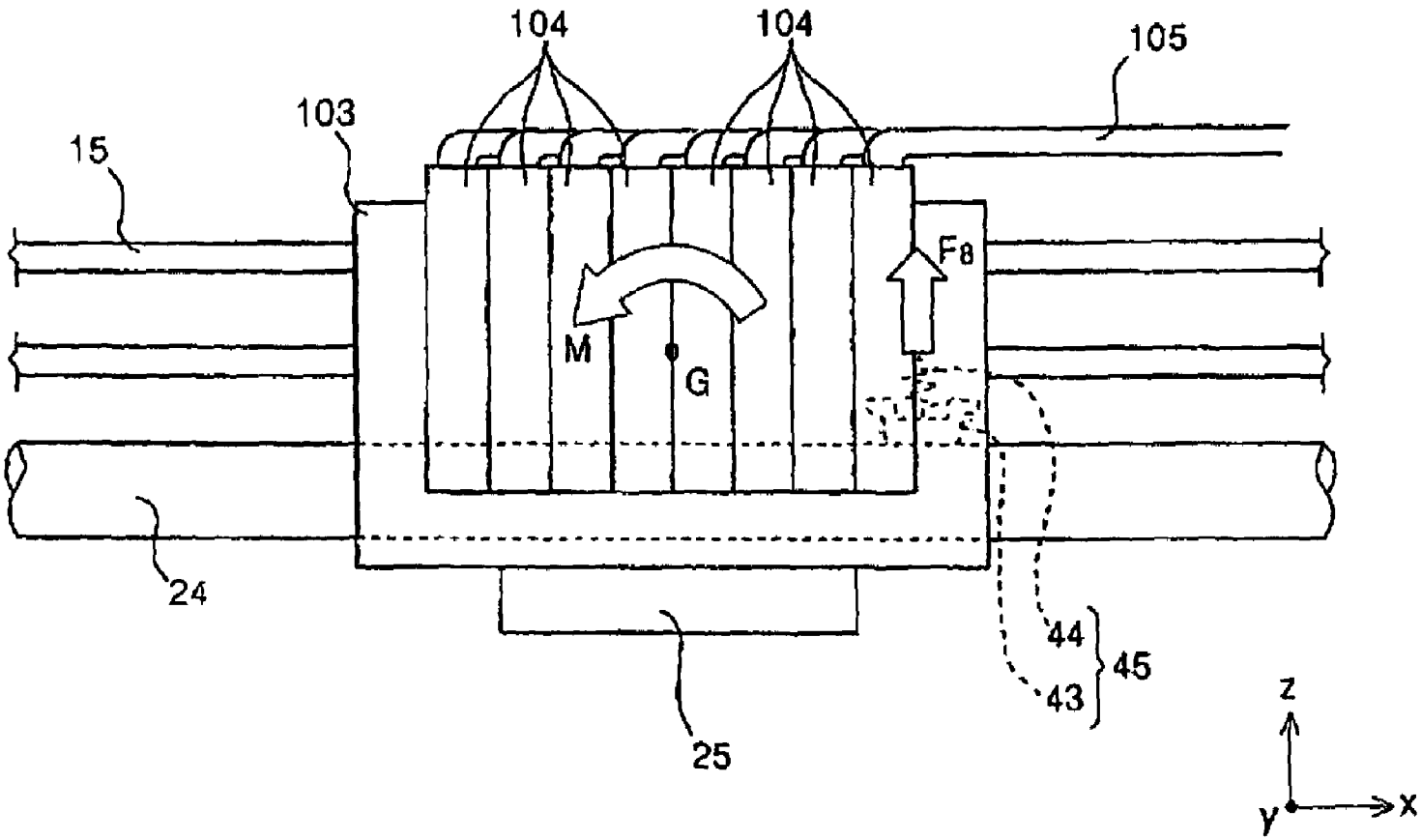
FIG. 10 is an enlarged view of a carriage in the ink jet printer of FIG. 9.

As shown in FIG. 10, the ink supply tube 105 extends upward from the top face of the carriage 105 as well as extends in the primary scanning direction. The ink supply tube 105, with its self-restoration property, gives a rotation moment about a centrium G of the carriage 103 (rotation moment in clockwise or counterclockwise direction in FIG. 10: rotation moment in the z-x plane) in the front view of the carriage 103.

Thus, in this embodiment, a force F8 is generated in the z-x plane by a moment generator 45 between the carriage 103 and the guide shaft 24 so as to cause the ink supply tube 105 to generate a rotation moment M in the working plane (the z-x plane) of the rotation moment to be given to the carriage 103. The force F8 is set to a magnitude of a rotation moment in a fixed direction denoted by an arrow M to be generated on the carriage 103 irrespective of the position of the carriage 103 in the primary scanning direction, that is, irrespective of the direction of the rotation moment given to the carriage 103 by the supply tube 105. This considerably reduces the swing phenomenon of the carriage 103 thereby substantially eliminating the deviation in the ink landing positions.

The urging direction of the force F8 may be arbitrary if the rotation moment is so generated as not to change the direction of the sum of the rotation moments generated in the carriage irrespective of a change in the routing state of a flexible member (a composite body of a tube and a cable or a tube or a cable) with the movement of the carriage in the primary scanning direction. A plurality of moment generator may be provided instead of a single moment generator in the foregoing embodiments.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims. For example, the term "recording head" includes not only the above-described ink jet recording head but also a thermal recording head and a dot-impact recording head.

What is claimed is:

1. A liquid ejecting apparatus, comprising:

a liquid ejecting head, adapted to eject liquid toward a target medium;

a guide shaft, extending in a first direction;

a carriage, reciprocately carrying the liquid ejecting head in the first direction while being guided by the guide shaft; and a moment generator, disposed between the carriage and the guide shaft at a position shifted from a centrum of the carriage in the first direction, and exerting a force directed in a second direction perpendicular to the first direction, thereby generating a first rotation moment in the carriage, wherein the first direction includes a third direction and a fourth direction which are opposed to each other, when the carriage carries the liquid ejecting head in the third direction, the first rotation moment generated by the moment generator is directed in a direction, and when the carriage carries the liquid ejecting head in the fourth direction, the first rotation moment generated by the moment generator is directed in the direction.

2. The liquid ejecting apparatus as set forth in claim 1, wherein the moment generator comprises: a slider, retractably brought into contact with the guide shaft so as to be slidable thereon; and a spring, urging the slider against the guide shaft, the spring is disposed between the carriage and the slider and exerts the force directed in the second direction.

3. The liquid ejecting apparatus as set forth in claim 1, further comprising:

a liquid container, disposed at a position separated from the carriage and containing liquid therein; and a flexible member, connecting the liquid container and the liquid ejecting head and adapted to supply the liquid from the liquid container to the liquid ejecting head.

4. The liquid ejecting apparatus as set forth in claim 3, wherein the direction of the first rotation moment is unchanged irrespective of a moving direction of the carriage at least when the carriage is placed within a region in which the liquid ejecting head performs liquid ejection with respect to the target medium.

5. The liquid ejecting apparatus as set forth in claim 3, wherein the flexible member generates a second rotation moment in the carriage, which is directed in the same direction as the direction of the first rotation moment.

6. The liquid ejecting apparatus as set forth in claim 5, wherein the second rotation moment is generated at least when the carriage is placed within a region in which the liquid ejecting head performs liquid ejection with respect to the target medium.

7. The liquid ejecting apparatus as set forth in claim 3, further comprising a flexible flat cable, connected to the liquid ejecting head to supply signals thereto, and being deformable in accordance with the reciprocation of the carriage.

8. The liquid ejecting apparatus as set forth in claim 7, wherein the flexible flat cable and the flexible member extend adjacently to each other.

9. The liquid ejecting apparatus as set forth in claim 7, further comprising a flexible plate member which is deformable in accordance with the reciprocation of the carriage and is integrated with the flexible member.

10. The liquid ejecting apparatus as set forth in claim 1, wherein:

the guide shaft includes a first shaft and a second shaft;

the carriage is formed with a bearing hole through which the first shaft extends; and the second shaft supports the carriage so as to prevent the carriage from rotating about the first shaft.

11. A recording apparatus, comprising:

a recording head, adapted to perform recording on a recording medium;

a guide shaft, extending in a first direction;

a carriage, reciprocately carrying the recording head in the first direction while being guided by the guide shaft; and a moment generator, disposed between the carriage and the guide shaft at a position shifted from a centrum of the carriage in the first direction, and exerting a force directed in a second direction perpendicular to the first direction, thereby generating a rotation moment in the carriage, wherein the first direction includes a third direction and a fourth direction which are opposed to each other, when the carriage carries the liquid ejecting head in the third direction, the first rotation moment generated by the moment generator is directed in a direction, and when the carriage carries the liquid ejecting head in the fourth direction, the first rotation moment generated by the moment generator is directed in the direction.

* * * * *